US005794637A

United States Patent [19]

Figueroa

[11] Patent Number: 5,794,637

[45] Date of Patent: Aug. 18, 1998

[54] NON FLIP UMBRELLA

[76] Inventor: Luisito A. Figueroa, 183 Sinag Street, Mandaluyong Metro Manila, Philippines

[21] Appl. No.: 793,002

[22] PCT Filed: Oct. 11, 1994

[86] PCT No.: PCT/US94/11529

§ 371 Date: Jan. 28, 1997

§ 102(e) Date: Jan. 28, 1997

[87] PCT Pub. No.: WO96/03898

PCT Pub. Date: Feb. 15, 1996

[51] Int. Cl.[6] ..... A45B 25/02

[52] U.S. Cl. ..... 135/27; 135/28

[58] Field of Search ..... 135/27, 28, 29, 135/37, 38, 39, 16

[56] References Cited

U.S. PATENT DOCUMENTS

| | | | |
|---|---|---|---|
| 559,577 | 5/1896 | Hadfield | 135/27 |
| 850,341 | 4/1907 | Callahan . | |
| 1,444,017 | 2/1923 | Waschek . | |
| 2,143,978 | 1/1939 | Eeles . | |
| 2,522,645 | 9/1950 | Senna . | |
| 3,930,514 | 1/1976 | Wu . | |
| 4,274,429 | 6/1981 | Kinski . | |
| 4,407,317 | 10/1983 | Crandall . | |

FOREIGN PATENT DOCUMENTS

| | | | |
|---|---|---|---|
| 121459 | 7/1927 | Switzerland | 135/27 |

*Primary Examiner*—Lanna Mai

*Attorney, Agent, or Firm*—Julian Caplan; Flehr Hohbach Test Albritton & Herbert LLP

[57] ABSTRACT

An umbrella of the type having a canopy that is fastened to a folding radial frame with hinged ribs radiating from a center pole, and a sliding catch which pivotally supports the braces of said ribs is disclosed. Secured between the sliding catch and the ribs is the reinforcing guy assembly. This assembly consists of elongated strings having its inner ends connected to said sliding catch and its outer ends connected to the outer ends of said ribs, and suspender means having its lower ends connected to said elongated strings and its upper ends connected to said ribs.

4 Claims, 3 Drawing Sheets

NON FLIP UMBRELLA

BACKGROUND AND SUMMARY OF THE INVENTION

The present invention relates generally to improvement in umbrella construction and, more specifically it relates to a non flip umbrella.

Commonly available umbrella used as a protection against the weather consists of a fabric canopy that is fastened to a skeletal frame with pivotally hinged ribs or braces radiating from a center pole or handle. A movable member defined by a sliding catch pivotally supports the braces of the ribs. The umbrella has a convex dome when open, and can be opened by sliding up or folded by sliding down said sliding catch.

The aforementioned conventional umbrella, though widely accepted satisfactorily by the end-user still encounters one pronounced defect. It has been observed that the fabric canopy is sustained in open or extended position merely by the force of the braces which bear on their ends to the sliding catch and at their outer ends against the respective ribs to which they are connected. Said braces and ribs cooperatively form a linkage-like support for the whole structure. Said linkage-like support is usually subjected by the lateral pressure of the weather which is always exerted against the outer edges of the fabric canopy. During windy weather condition (e.g. typhoon/storm), the fabric canopy together with the supporting ribs tends to flip-over or collapse over when a gale of wind or continuous strong wind blows through the inside of said umbrella thereby totally incapacitating the umbrella giving inconvenience to its user.

In view of the defects found in the utilization of the existing umbrellas, there is therefore a need to positively secure and/or reinforce the ribs and braces of the umbrella so as to preclude the tendency of collapsing over thereof. Accordingly, the present invention contemplates to introduce a guy assembly which could appreciably secure rigidly the ribs of the umbrella and thereby making it capable of positively sustaining the ribs in correct position without flipping over.

Another object of the invention is to provide a non flip umbrella wherein the guy assembly incorporated thereof has an inner end connected to said sliding catch and the outer end connected to said respective ribs.

A further object of the invention is to provide a non flip umbrella which is so simple in structure, permits facile assembly and reliable.

The objects of the invention, and its characteristic features and advantages will be further understood in the following detailed description taken in conjunction with the appended drawings.

IN THE DRAWINGS

Figure 7:
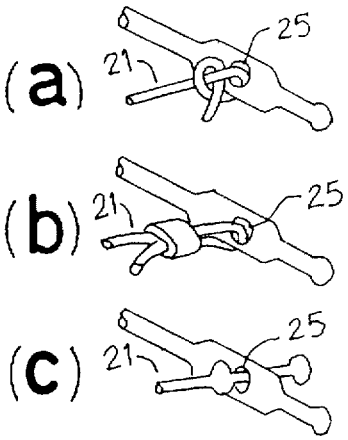

FIG. 7(*a*) (*b*) (*c*) is a fragmentary view showing the mode of connecting the guy assembly with the ribs of the umbrella.

DETAILED DESCRIPTION

Referring now in detail to the several views of the drawings wherein like reference numerals designate the same parts throughout, there is illustrated a non flip umbrella which is generally designated by the reference numeral 10. This umbrella 10 conventionally comprises an elongated center pole 11 provided with an apex in the form of a hub 12 encompassingly fixed at the upper end of said center pole 11 and a series of ribs 13 hingely connected to said hub 12 and spacedly radiating from said center pole 11. Movably secured on said center pole 11 and proximately below the hub 12 is the sliding catch generally designated by the reference numeral 14, as in conventional structure, the sliding catch 14, defines a cylindrical sleeve 15 having at the upper terminal end thereof an integral channeled hub 16, said hub 16 being provided with a series of radially spaced slits 17. Disposed within said channeled hub 16 is a ring 18. Hingedly connected on said ring 18 and passing through said slits 17 is the inner end of a series of braces 19, their outer ends being hingedly connected to the respective ribs 13. The steadying force of this braces 19 supports the respective ribs 13 in erect and steady position when the umbrella is opened.

Figure 1:
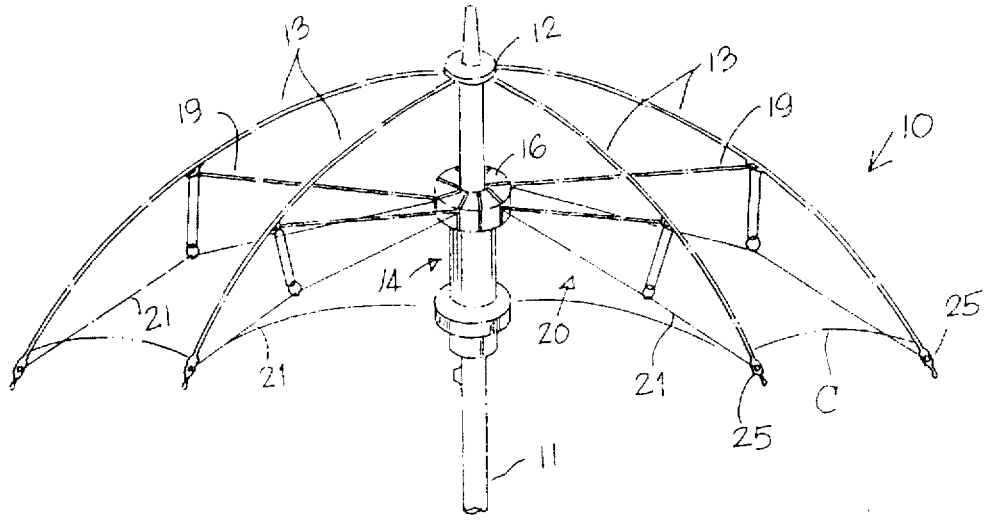
FIG. 1 is a perspective view of the non flip umbrella in erect or suspended position and showing the guy assembly thereof.
Figure 2:
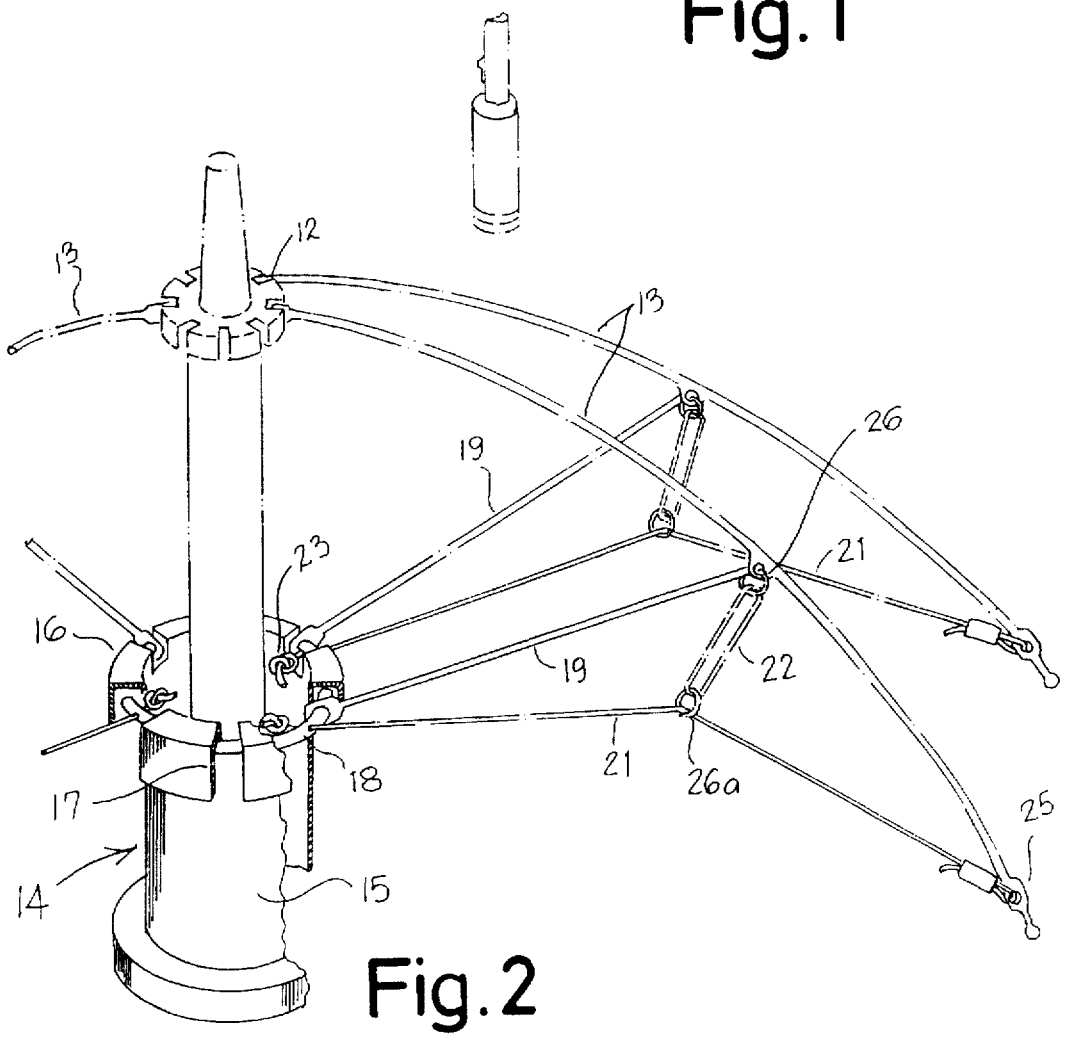
FIG. 2 is an enlarged side elevational view, partly sectioned, showing one of a series of reinforcing string of the guy assembly of the umbrella.
Figure 3:
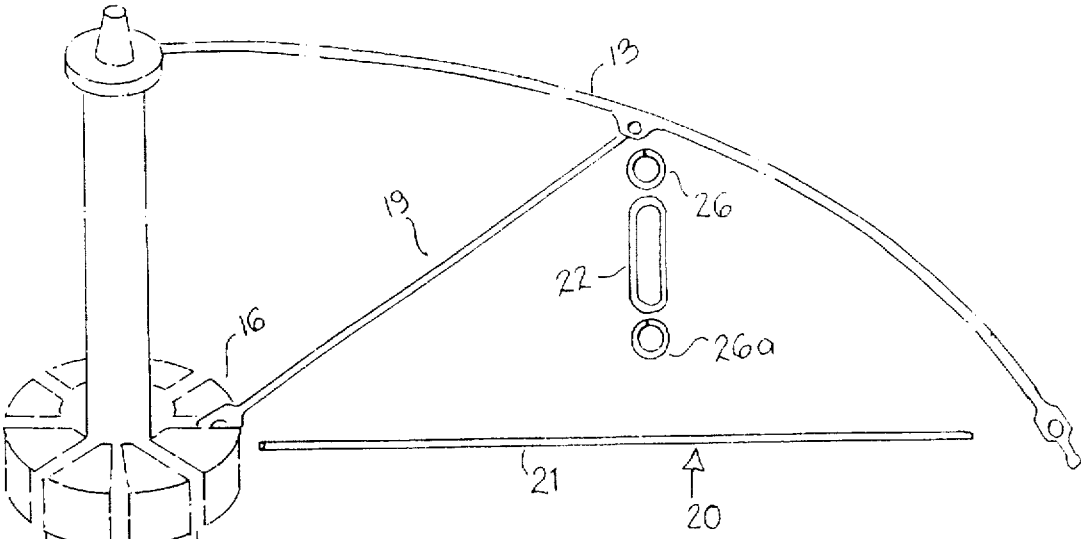
FIG. 3 is an exploded view of the guy assembly as shown in FIG. 2.

The improvement herein proposed which is absent in existing umbrella construction is directed solely to the reinforcing guy assembly which is generally designated by the reference numeral 20. As best illustrated in FIGS. 1 to 3, this guy assembly 20 which is adapted to be connected between ribs 13 and the sliding catch 14 essentially consists of a series of elongated reinforcing strings 21, and a series of complemental suspender means 22. Said suspender means 22 being extended between the reinforcing strings 21 and the ribs 13. While nylon cord material is preferred, as reinforcing string 21 other strong material such as wire string could suffice. Each of said reinforcing strings 21 having a length of between 12 and 45 inches radiate spacedly from said sliding catch 15 their inner ends 23 being connected to the ring 18 which is within the confines of the channeled hub 16, while the outer end 24 is secured to the eyelet 25 of the respective ribs 13 it is also possible to secure said outer end 24 to the outer end of said braces 19. Secured also on this eyelet 25 is the outer ends of the fabric canopy C.

Figure 6:
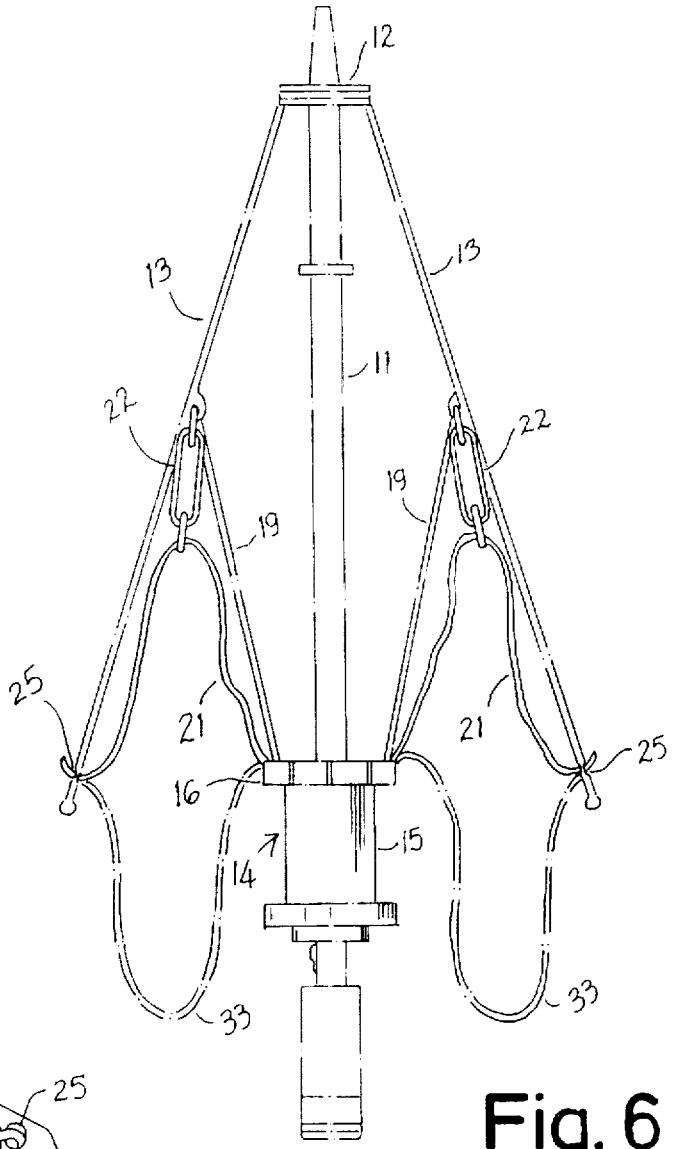
FIG. 6 is a side elevational view of the non flip umbrella in partially folded position.

Each of the suspenders 22 is held in position by a pair of upper and lower rings 26 and 26*a* or other suitable conventional connecting means, the upper ring 26 is connected to the respective ribs 13 while the lower ring 26*a* is secured to the reinforcing strings 21. This suspenders 22 is adapted as an auxiliary support so that the reinforcing string 21 will not sway out of place and at the same time prevent the reinforcing strings 21 from drooping out of the umbrella as 33 when said umbrella is folded as shown in FIG. 6.

Figure 4:
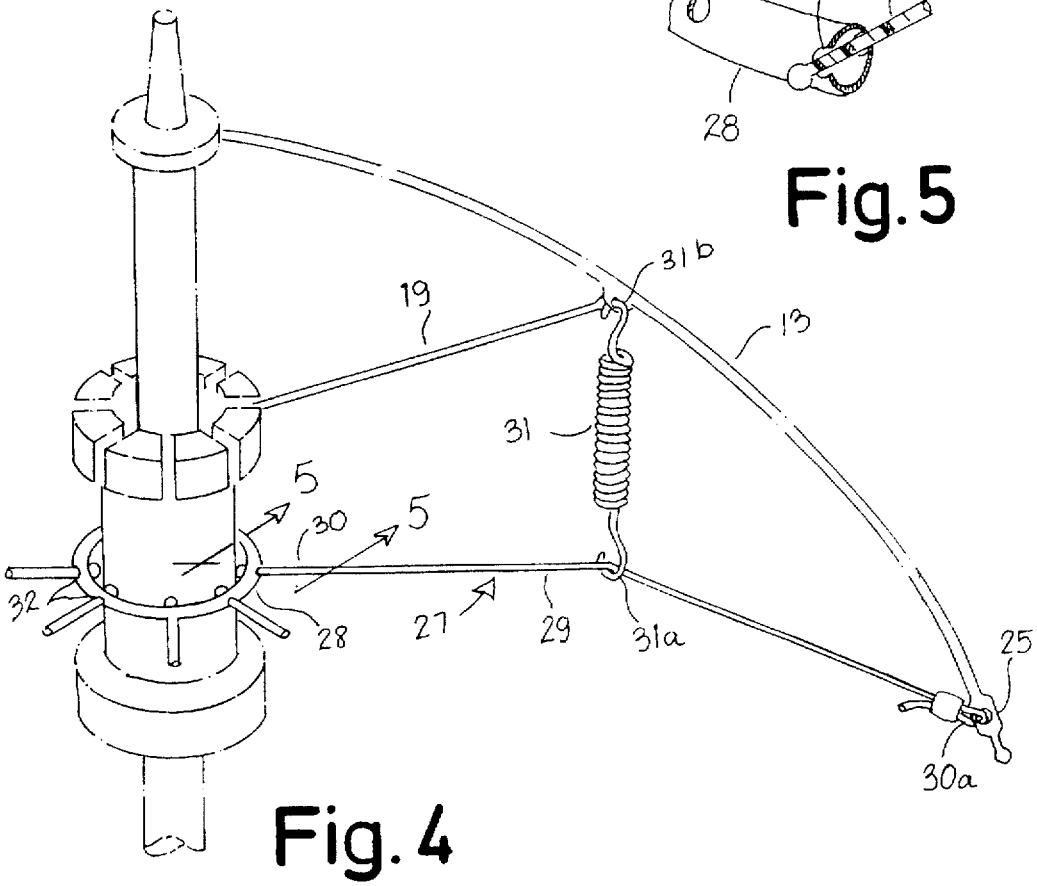
FIG. 4 is another embodiment of the guy assembly as shown in FIG. 1 to 3.

FIG. 4 shows an alternative embodiment of the non flip umbrella showing the guy assembly on a different construction. As illustrated, the embodied assembly is generally designated by the reference numeral 27. This assembly 27 now consists of a circular ring member 28 which is encompassingly secured to the sleeve 15 of said sliding catch 14 of the umbrella. Said ring member 28 defines a series of radially disposed apertures 32 where elongated reinforcing strings 29 radiates therefrom towards the outer ends of the ribs 13. Said reinforcing strings 29 having a length of no less than 12 inches and no more than 45 inches have an inner end 30 being secured on said ring member 28 and the outer end 30*a* being secured to the eyelet 25 of the respective ribs 13 said outer end 30*a* can also be securely connected to outer end of said braces 19. Suspending each of said reinforcing string 29 is the complemental suspension means in the form of a helically coiled suspension spring 31. Said suspension spring 31 has an opposed ends 31A and 31B being securely connected to the reinforcing string 29 and the ribs 13, respectively. While said helically coiled suspension spring 31 is the preferred material for said suspending means, other conventional material which serves the same purpose may be used. In this embodiment, it may be noted that the inner ends 30 is no longer connected to the hub 16 of the sliding catch 14 and, in lieu thereof, to the ring member 28. While this ring member 28 is shown to be in the form of a ring as shown in FIG. 4, other configuration such as circular band, etc. can also be used.

Figure 5:
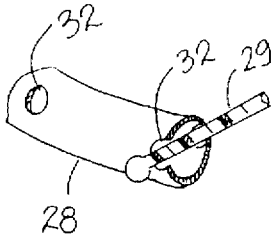
FIG. 5 is a cross-sectional view taken along line 5—5 of FIG. 4.

FIG. 5 shows along line 5—5 of FIG. 4, the inner end of said reinforcing string 29 in one of different ways of connecting said reinforcing string 29 to said ring member 28, here the inner end of said reinforcing string 29 is embossed to keep said reinforcing string 29 connected to said ring member 28.

Although embossing is preferred to connect said reinforcing string 29 to said ring member 28 other ways such as knotting etc. can also be adapted.

FIG. 7 shows the different ways of connecting the reinforcing strings 21 and 29 in relation with eyelet 25. FIG. 7(*a*) is shown by way of knot, FIG. 7(*b*) by looping and the short end clipped together with the long part, with metal, plastic or nylon material, and FIG. 7(*c*) by expanding or embossing the ends of said reinforcing strings 29. It should also be understood that in order to sustain the umbrella from not flipping over depends on the quality and strength of the conventional materials used in the essential components of the herein improved umbrella.

What I claim as my invention is:

1. In an umbrella of the type having a fabric canopy fastened to a folding radial frame with hinged ribs radiating from a center pole, a sliding catch movable in an up and down manner encompassingly secured on said center pole, said sliding catch defining a cylindrical sleeve provided with an integral hub at the upper end thereof, braces hingedly connected to said hub in their inner ends and to said ribs in their outer ends; the improvement wherein said catch is non-rotatable relative to said pole and which further comprises a reinforcing guy assembly positioned between said sliding catch and said ribs, said guy assembly comprising a plurality of radially disposed reinforcing strings, the inner ends of said reinforcing strings being connected to said sliding catch, and the outer ends of said reinforcing strings being connected to said respective ribs, a plurality of suspending means respectively disposed above each of said reinforcing strings and below said braces, each said suspending means having a lower end connected to said reinforcing strings and an upper end fixedly connected to said ribs, whereby said suspending means tightens said reinforcing strings to hold said reinforcing strings in place and prevents said reinforcing strings from drooping when said umbrella is folded, said reinforcing guy assembly further comprising a circular ring member, said ring member encompassingly positioned on said sleeve of said sliding catch, the inner ends of said reinforcing strings being connected and disposed radially relative to said ring member, the outer ends of said reinforcing strings being connected to said ribs.

2. An umbrella of the type as in claim 1 wherein said suspending means comprising helically coiled springs.

3. An umbrella of the type as in claim 1 wherein the lower ends of said suspending means are slidably connected to said reinforcing strings.

4. An umbrella of the type of claim 1 wherein there are spaced apart first and second eyelets on each said rib, the outer ends of said reinforcing strings being connected to said first eyelets and said upper ends of said suspending means being connected to said second eyelets.

* * * * *